United States Patent [19]

Weber et al.

[11] 3,980,048

[45] Sept. 14, 1976

[54] LIQUID DEVELOPMENT APPARATUS

[75] Inventors: Guy Weber, Arques la Bataille; Pham Kim Quang, Dieppe, both of France

[73] Assignee: La Cellophane, Paris, France

[22] Filed: Mar. 24, 1975

[21] Appl. No.: 561,546

[30] Foreign Application Priority Data

| | | |
|---|---|---|
| Apr. 2, 1974 | France | 74.11626 |
| Jan. 10, 1975 | France | 75.00658 |
| Jan. 17, 1975 | France | 75.01385 |

[52] U.S. Cl. ..... 118/637; 118/401; 354/317; 355/10

[51] Int. Cl.[2] ..... G03G 15/10

[58] Field of Search ..... 118/637, 421, DIG. 23, 118/243; 427/15–17; 355/10; 354/317; 352/130

[56] References Cited

UNITED STATES PATENTS

| | | | |
|---|---|---|---|
| 875,546 | 6/1907 | Metzner | 118/401 X |
| 1,609,218 | 11/1926 | Storck | 118/401 |
| 2,771,047 | 11/1956 | Zimmerman | 118/421 X |
| 3,356,066 | 12/1967 | Larsson et al. | 118/401 X |
| 3,583,362 | 6/1971 | Trattner et al. | 118/401 |

*Primary Examiner*—Morris Kaplan

*Attorney, Agent, or Firm*—Sherman & Shalloway

[57] ABSTRACT

A device and a process for the liquid development of electrostatic latent images on a sheet surface which comprises: moving sheet material having said electrostatic latent images pass a reservoir containing developing liquid and having an open upper part and a lower part with openings through which the developing liquid passes, applying said sheet by capillary action against said lower part openings, whereby the amount of developing liquid is applied as needed.

12 Claims, 5 Drawing Figures

LIQUID DEVELOPMENT APPARATUS

BACKGROUND OF THE INVENTION

1. Field of the Invention

The present invention relates to a device for liquid development in a reproduction machine which is operated on a sheet by sheet basis. More particularly, this invention relates to a method and device for developing electrostatic latent images on a sheet surface with a developer having a liquid developing system.

Such a developer may be an autonomous unit but, preferably, it is incorporated in a combined reproduction machine having associated exposure devices and development devices. It is particularly appropriate for incorporation into a reproduction machine which is operated on sheet by sheet basis, in which the original and the copy sheet are stationary and in parallel planes during exposure. The exposure is preferably performed by back and forth movement in a plane parallel to that of the sheets by a mobile unit which especially carries a lamp and optic system.

2. Discussion of the Prior Art

Known liquid development systems operate, in general, either by immersion of the sheet to be developed into a tank that contains a liquid developer which is kept agitated, or by application of the liquid to the sheet by means of rollers. The first mentioned system has the drawback of excessively wetting the paper and requiring the use of a drying system. The second mentioned system does not easily lend itself to the development of separate sheets.

U.S. Pat. No. 3,367,791 of Lein provides a roller dipping into a liquid bath, which roller is operated at speeds such that a hydrodynamic pressure is created against the surface of the sheet, holding the latter against a back guide which is located at a fixed, determinate spacing from the closest point of roller approach. The roller is made conductive, or at least has a highly conductive surface layer, which provides the field control effect required at the point where electrostatic deposit of particles is occurring. The motion of the roller in addition to providing the hydrodynamic forces for sheet control, also renders the liquid action sufficiently turbulent to provide a constant changing and replenishing action which will forestall the possibility of the developing liquid's reaching a starved or depleted condition at the developing location where rapid particle deposit is occurring due to the presence of the highly efficient field control.

U.S. patent application, Ser. No. 537,600, filed Dec. 30, 1974, of Pham Kim Quang, et al, provides a device which makes it possible to assure sheet by sheet development of electrophotographic papers, having the photoconductive face turned upward, and at the same time permits the development to take place by the sufficiently prolonged action of a constantly renewed and enriched liquid developer under the action of a suitably arranged electric field.

SUMMARY OF THE INVENTION

The present invention relates to apparatus for a liquid development process for electrostatic images on electrophotographic sheet material characterized in that the sheet to be developed is carried mechanically with a previously printed sensitive face turned upward and the sheet is applied by capillarity against the lower face of a reservoir which is open in its upper part and carrying in its lower part openings through which the developer flows. Also, that the sheet is applied against the reservoir during its entire movement so as to take the developer only when needed.

The excess developer which escapes from the reservoir is collected in a tank or container from which it can be recovered by any conventional means such as by pumping and sending it back to the reservoir.

Preferably, the reservoir utilized in the invention is normally in the tank from which it is filled with liquid developer and may be raised above the tank when a sheet is presented for developing. The reservoir may be adapted to apply a sufficient amount of developer to a sheet of given size which is traveling at a pre-determined speed. The liquid flow time may be controlled by the size of openings placed in the lower part of the reservoir.

The copy sheet which is printed may be brought mechanically under the reservoir by any known means where it begins contact at the place where the developer flows. It has been found that the surface tension of the liquid keeps it applied to the reservoir during its entire movement wherein it takes the developing liquid as required.

Raising and positioning of the reservoir when a sheet is presented for developing, and its withdrawal to its initial position in the tank once the sheet has been developed, may be realized by any known means, either manual, automatic, mechanical, electrical or other means. It is the same with the carrying movement for the copy sheets.

In the developer according to the present invention, these movements may be linked with the movement of a mobile means carrying a lamp and optic system, which performs the exposure operation. During the return movement, the mobile means causes the lifting of the reservoir and ejection of the printed copy sheet which it brings in contact with the lower face of the reservoir.

It is an object of the present invention to provide sheet by sheet development in a reproduction machine having satisfactory rapidity and reliability of function, and a good quality of development which persists even in the case of extended functioning.

BRIEF DESCRIPTION OF THE DRAWINGS

For a fuller understanding of the nature and objects of the present invention, reference should be had to the following description taken in connection with the accompanying drawings, in which.

DESCRIPTION OF THE PREFERRED EMBODIMENTS

Figure 1:
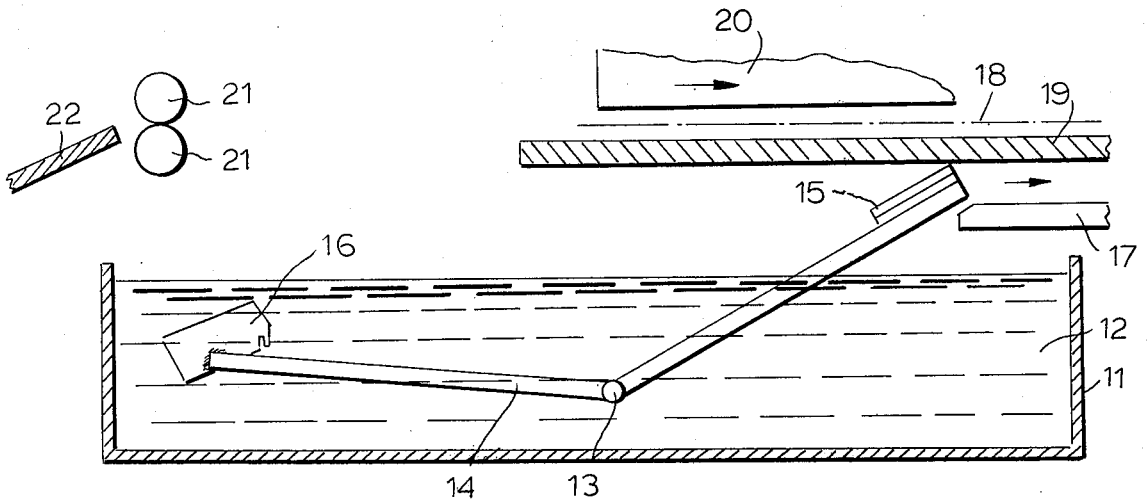
FIG. 1 is a schematic illustration of an apparatus for the development of electrophotographic papers in accordance with the present invention.
Figure 2:
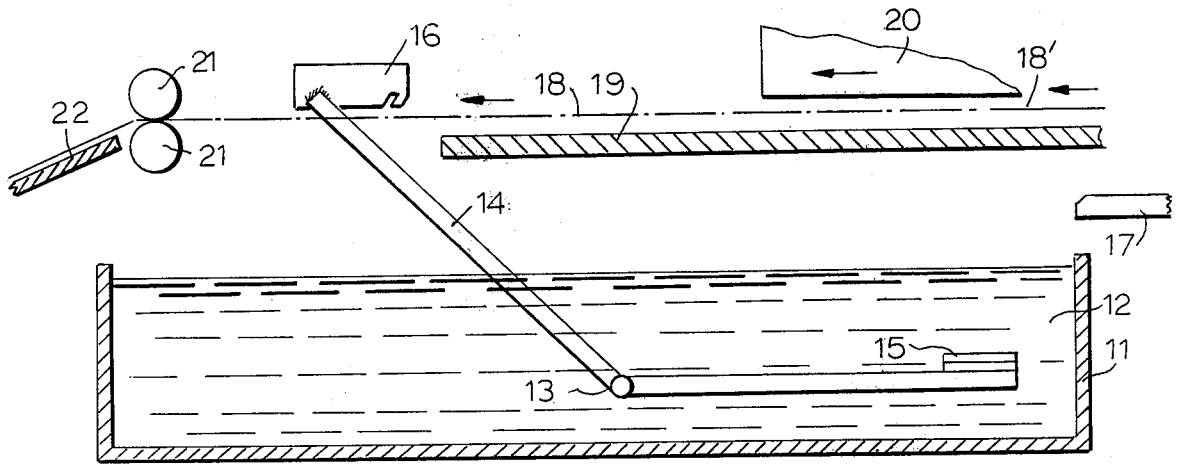
FIG. 2 is a schematic illustration of the apparatus of FIG. 1 in the development position.

A developing device according to the present invention is illustrated schematically by FIGS. 1 and 2. In FIG. 1, the apparatus is shown in the rest position, while in FIG. 2 it is shown during the development process.

As shown in FIG. 1, tank 11 contains a liquid developer 12 whose level is kept constant by any known means (not shown). Inside the tank 11 a support 14 is articulated around a shaft 13. One of the ends of the support 14 is connected with a counterweight 15 and the other end is connected with a reservoir 16 which is open in its upper part and has openings in its lower part. The tank 11 is kept in the rest position by a bolt 17.

A copy sheet 18 is placed on a plate 19 which partially covers the tank 11.

As seen in FIG. 1, when mobile means 20, which contains an optic system that moves in the direction of the arrow, has exposed sheet 18 and comes to the end of its travel, it moves aside bolt 17 of counterweight 15 so as to cause the swinging of the reservoir 16 which takes the position shown in FIG. 2.

As seen in FIG. 2, during the return to its original position, mobile means 20 causes the movement of copy sheet 18 so as to contact the lower face of the perforated reservoir 16. The sheet 18 remains applied by capillary action against the reservoir 16 and is grasped between a pair of carrying rollers 21 which also act as drying rollers. The rollers 21 eject the sheet 18 onto the receiving table 22 while another copy sheet 18 is brought into position by the optic unit which completes its return movement. The optic unit completes its return movement by a system of cams and levers (not shown) which causes the return to the reservoir 16 into the tank 11 and in the rest position shown in FIG. 1.

Reservoir 16 is connected with a V-shaped support plate 14 which is articulated around a stationary shaft 13. Plate 14 may be any suitable shape and is utilized during the swinging of the reservoir 16 as a stirrer so as to contribute to the homogenizing of the liquid developer.

Preferably, the reservoir 16 has a parallelipipedic configuration and its lower part has the shape of a dihedron. The lower part also contains at least one groove and is provided with holes. The groove preferably has only a slight depth and is utilized for homogenizing the development over the entire width of the sheet by causing a flow of developing liquid by capillarity and by preventing the development from being more pronounced plumb with the holes than in their intervals.

Figure 3:
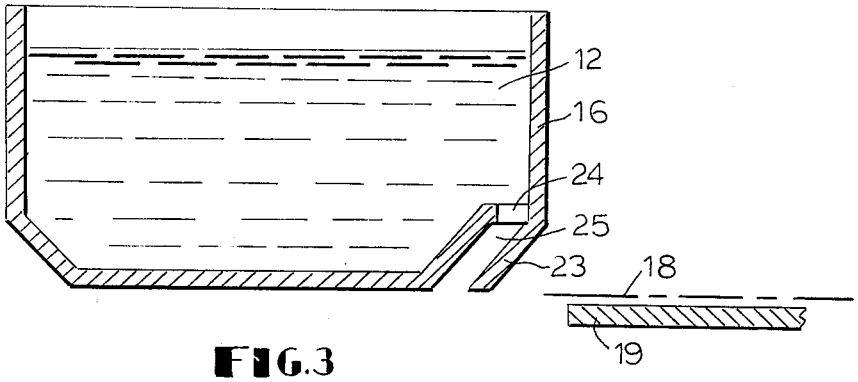
FIG. 3 is a schematic profile of the reservoir used with the apparatus of FIG. 1.

As seen in FIG. 3, the reservoir 16 is represented in profile. The lower part of the reservoir 16 has formed a crosswise groove 25, the bottom of which is provided with holes 24 through which the developing liquid flows. Inside the slot formed by the groove 25, liquid coming from each hole combines and constitutes a continuous screen which flows on a wall 23. The wall 23 is preferably inclined in the development position from the groove. The inclination located at this place to the reservoir wall may between 20° and has the effect of guiding the outside edge of copy sheet 18 and preventing it from hooking upon contact with the wall.

The combination of the characteristics, namely the inclination of the slot, its width, the diameter and number of the holes, governs the delivery of the developer. These values are therefore chosen as a function of the liquid necessary for the development of a sheet and also of the volume of liquid taken by the reservoir. It is advantageous not to increase this volume too much while providing a sufficient volume to assure a flow during the entire passage of the sheet. In practice, for the development of sheet sizes A4, the volume of the reservoir should be in the order of 50 cc and not exceed 100 cc.

It has been found that a width of the slot and diameters of the holes between 0.5 and 2 mm with the holes being spaced apart 20 to 40 mm gives satisfactory results.

The distance between the edge of plate 19 and the wall closest to the reservoir should be as short as possible to avoid an excessive loss of developer before the beginning of the development, and to prevent the sheet from falling into tank 11. However, a certain delay is always necessary to permit a continuous flow to be established through the slot. It has been found that a distance in the order of 3 to 5 mm gives satisfactory results.

The reservoir may be made of any material or association of suitable materials. However, the plane part of the reservoir which comes in contact with the surface to be developed should preferably be metallic or covered with a perfectly polished metal plate. It would be useful for this metallic surface to be able to be brought to a suitable potential to improve, as is known, the quality of the development.

On the other hand, it has been found, according to a variant, that the quality of the development can be improved if the reservoir were covered in its lower part with a grill or grid of very fine mesh, the sheet being developed coming by capillarity to lick this grill or grid and no longer the surface itself of the reservoir.

A better quality of development results due to a more homogeneous distribution of the liquid particularly when some of the orifices of the reservoir become stopped up. The presence of the grill causes a perfectly homogeneous distribution of the liquid inside the meshes which eliminates the inequalities of development which can occur in particular in the front and back zones of the sheet.

On the other hand, the presence of this grill makes it possible to simplify the shape of the reservoir and eliminate the need of providing a plate parallel to the oblique wall of the reservoir to equalize the flow of the liquid.

The grill, in accordance with the present invention, can be made of any suitable metal, but preferably a metal chosen as a function of the staticelectricity produced by friction of the paper on the grill. Actually, it is advantageous that this metal acts as a donor of charges of the sign since it is necessary for the development of the electrophotographic paper.

In the case of zinc oxide papers which are most frequently used, are charged negatively before the formation of the image and are normally developed by means of a developer containing positive charges, they are preferably chosen for the grill metals whose electronegativity is greater than that of zinc on the Pauling scale of 1.6, for example, copper which is at the level of 1.9 or one of its alloys, such as bronze or brass. Preferably, the positive charges which will be formed on the surface of the zinc oxide paper by friction against the copper or brass grill in the exposed zones repel the developer particles and are themselves positive toward the image zones which contribute to eliminating the risks of formation of a pigmented background and improve the quality of the reproduction.

The size of the meshes of the grill is not critical. However, they should only be fine enough to retain the developer liquid by capillarity.

Figure 4:
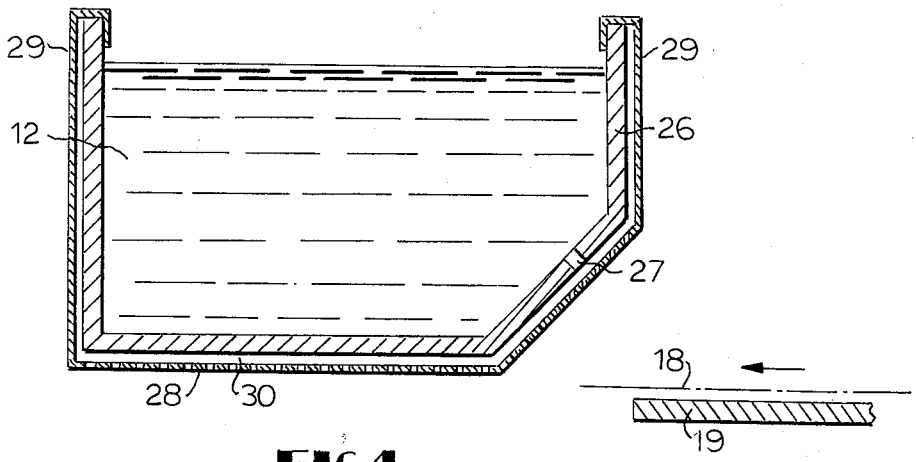
FIG. 4 schematically illustrates one form of a reservoir which can be utilized in the apparatus according to the present invention.

A reservoir according to the present invention is shown by FIG. 4.

This reservoir 26 which contains a developer liquid 12 has a bottom in the shape of a dihedron with one of its faces being horizontal in the raised position. The oblique face of this dihedron is provided with a plurality of orifices 27 through which the liquid flows. A very fine mesh grill 28 preferably encases the lower part of the reservoir with standards 29 allowing it to be supported on the edges of the reservoir.

The liquid which escapes through orifices 27 flows homogeneously into the space 30 between the reservoir wall and the grill 28 which encases its lower part and is kept in this space by capillary action until a sheet 18 which is to be developed and is moving in the direction of the arrow on guide plate 19 comes into contact with the grill 28.

Sheet 18 is held by capillary action during its advance in contact with the grill 28 and it takes through the grill mesh the amount of developer liquid it needs for its development without excess.

It has been found that the quality of the development can be improved still further by adding to the mobile reservoir another grill or drilled plate which is in contact with it but electrically insulated and placed externally to the reservoir so as to be parallel to the lower face and in the proximity of the latter. This plate has the effect of facilitating the introduction of the paper sizes to be developed and their good application against the lower face of reservoir.

On the other hand, the plate may be brought to a determined potential, and preferably to the same potential as that of the reservoir, and imposes on the charged particles a constant electrostatic field due to this potential. The lines of force of this field which presides at the development should also be perpendicular to the surface of the sheet during development so as to improve the quality of the latter by reinforcing its contrast and eliminating the edge effect phenomenon.

Depending on the nature of the development: direct or reverse, i.e., depending on whether the sensitive surface and the developer particles are provided with charges of the opposite or same sign, the potentials to which the reservoir and plate should be brought are the similar or different. In case of direct development, the reservoir and plate are preferably electrically connected and grounded. In case of reverse development, the plate should be grounded, and the reservoir which is located on the charged side of the support should be advantageously brought to a determined potential which is experimentally established as a function of the nature of the support and the developer.

The plate in accordance with the invention is preferably connected with the mobile reservoir and is lifted with it at the time of development. It normally rests on the bottom of the tank and should have a wide clearance to permit the easy flow into the tank of the liquid carried by it during the lift. The plate can advantageously be made of a very wide mesh grill. It preferably should be of conductive metal so as to be able to be used as an electrode. Also, it should preferably be placed as close as possible to the lower face of the reservoir, a few millimeters from the latter and placed so as to guide the sheet to be developed against it or the grill which covers it when the reservoir is in a high position.

The metal comprising the plate should be chosen so that the developer is not deposited on it. During the movement of the particles in the developing medium there is produced by friction on the plate electrostatic charges as a result of static electricity. The metal comprising the plate should be such that the charges created on the surface of the latter are as much as possible of the same polarity as those which exist on the surface of the developer particles.

When electrophotographic paper with a zinc oxide base is used, the charge constituted by the latent image is negative and the particles of the developer liquid are normally positively charged. In this case, it is preferable that the electrostatic charges brought by static electricity to the surface of the plate also be positive so as to repel the developer particles. In such a case, stainless steels generally give good results.

Figure 5:
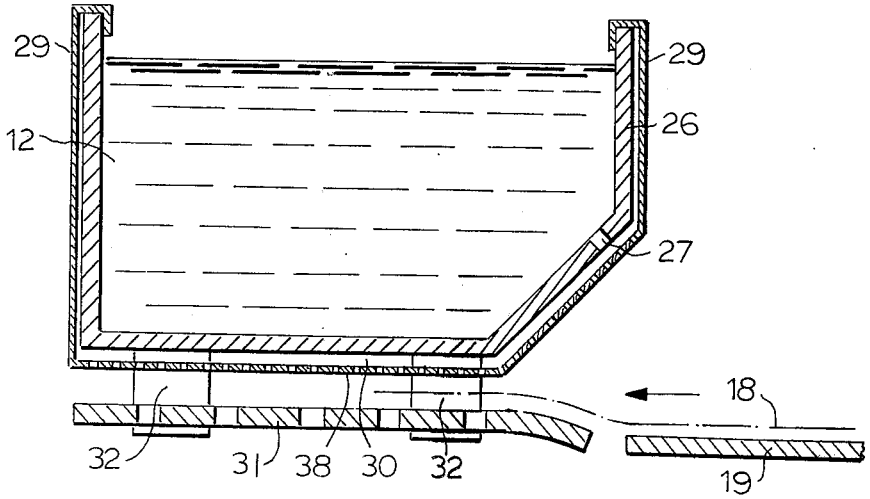
FIG. 5 is a schematic illustration of a reservoir used in accordance with the apparatus of the present invention which is provided with an electrode plate.

A reservoir provided with an electrode plate according to the present invention is represented schematically in section in FIG. 5.

The reservoir 26 which contains the developer liquid 12 is preferably of a parallelipipedic configuration, similar to that shown in FIG. 4. Also, it is preferably connected with a support (not shown) which is articulated around a shaft which permits it to swing to leave the tank which contains the developer and to come into the development position. This reservoir preferably has a bottom in the shape of a dihedron with one of its faces horizontal in the development position. The oblique face of this dihedron contains a number of orifices 27 through which the liquid flows. A very fine mesh grill 28 envelops the lower part of the reservoir and standards 29 permit it to be supported on the edges of the reservoir.

The developing liquid which escapes through orifices 27 flows homogeneously into space 30 between the reservoir wall and the grill 28 which envelops its lower face and is kept in this space by capillary action until a sheet 18 being developed and moving in the direction of the arrow on guide plate 19 comes in contact with the grill 28.

A perforated conductive metal plate 31, made solid with reservoir 26 by means of lugs 32 of electrically insulating material, is placed under the reservoir parallel to the lower face of the latter so that it guides sheet 18 to be applied against grill 28.

The plate 31 and reservoir 26 in the development position are preferably grounded or connected to a suitable potential by any known means (not shown). Thus, they produce an electrostatic field whose lines of force are perpendicular to the surface of the paper being developed which improves the quality of the reproductions.

The present invention is also adaptable for use with electrophotographic reproduction machines and particularly machines which combine in a single unit the exposure and development of documents.

These machines are further characterized in that the mobile unit which performs the exposure comprises, besides the lamp and optic system, a corona charging device. Further, downstream from the drying rollers, they may contain a developer fixing means.

It will be understood that the invention has been described with reference to the development of electrographic papers for greater ease in understanding; however, it is not limited to such development and extends to any liquid development in the field of photography, especially, diazotypy.

While preferred embodiments of the invention have been described and illustrated, it is to be understood that these are capable of variations and modifications. Accordingly, the invention is not limited to these specific embodiments, and variations and modifications thereof which are within the true spirit of the invention are included therein.

What is claimed is:

1. A liquid development device for a document reproduction machine operating on a sheet by sheet basis comprising: (a) a mobile reservoir open in its upper part and having a plurality of relatively small openings in a side wall of its lower part, (b) a stationary tank containing the liquid developer and said reservoir disposed within said tank below the free surface of the developer whereby to charge said reservoir, (c) a means for lifting said changed reservoir above said tank when a sheet is present for developing and returning it to its original position at the bottom of the tank when the development has been completed, said tank openings being associated with means to establish capillary flow of developer liquid from said reservoir when at its position above the tank whereby to dispose developer material having a free surface at the bottom of tank and retained thereat by surface tension, and (e) means for applying a sheet to be developed in wiping contact with said free surface of the liquid developer.

2. The development device of claim 1 wherein the lower portion of said reservoir is provided with metallic walls which are adaptable to be brought to a predetermined electrical potential.

3. The development device of claim 1 wherein said means to establish capillary flow and free surface comprises a plate which is parallel and closely spaced from said plurality of openings and sidewall wall so that the developer liquid which escapes from said orifices of said inclined wall flows by capillary action between the inclined wall and the plate.

4. The development device of claim 1 wherein said means to establish capillary flow and free surface comprises a unitary fine mesh metal screen disposed closely about and parallel to the lower sides and bottom wall of said reservoir to receive the liquid developer from said plurality of openings.

5. The development device of claim 4 wherein said grid comprises a metal whose electronegativity is greater than that of zinc.

6. The development device of claim 5 wherein said grid is a metal selected from the group consisting of copper, bronze, and brass.

7. The development device of claim 1 wherein said reservoir includes a perforated plate of electrically conductive metal, said plate being placed externally to said reservoir and parallel to its lower face.

8. The development device of claim 7 wherein said reservoir and said perforated plate are connected separately to a means for providing a predetermined potential.

9. The development device of claim 8 wherein the metal which constitutes the plate is of such a nature that the charge created on the surface of the latter under the action of the developer particles are of the same polarity as those which are placed on the surface of these particles.

10. The development device of claim 1 including drying roller means for carrying the sheet when developed and ejecting said sheet toward a receiving means.

11. The development device of claim 1 which is an electrophotographic reproduction machine.

12. A device for developing electrostatic latent images on sheet material which comprises:

means providing a bath of liquid developer containing particles electrically attractable to areas on the surface of the sheet;

an open top reservoir movable into and out of said bath of liquid developer, said reservoir being provided with a plurality of relatively small orifices in its lower portion through which the developing liquid flows;

a fine mesh metallic grid dispersed closely to and parallel with the reservoir bottom wall and said lower portion for receiving said developing liquid flow;

said mesh being of a size to retain the developing liquid by surface tension;

means for moving said reservoir into and out of said bath of liquid developer;

means for carrying a sheet whose surface has been electrostatically imaged to into contact with the developer liquid at the bottom of said grid;

means for establishing an electrical potential on said reservoir;

means for establishing an electrical potential on said grid means; and drying roller means for carrying said sheet when developed out of said device; whereby when a sheet is presented for developing, the reservoir is raised and the sheet is applied against the grid bottom and takes developing liquid.

* * * * *

UNITED STATES PATENT AND TRADEMARK OFFICE

CERTIFICATE OF CORRECTION

PATENT NO. : 3,980,048

DATED : September 14, 1976

INVENTOR(S) : Guy Weber et al

It is certified that error appears in the above--identified patent and that said Letters Patent are hereby corrected as shown below:

Claim 1, line 9, delete "changed", insert -- charged --

Signed and Sealed this

Ninth Day of November 1976

[SEAL]

*Attest:*

RUTH C. MASON
*Attesting Officer*

C. MARSHALL DANN
*Commissioner of Patents and Trademarks*